US008811837B2

(12) United States Patent
Yoshinaga et al.

(10) Patent No.: US 8,811,837 B2
(45) Date of Patent: Aug. 19, 2014

(54) FIXING DEVICE AND IMAGE FORMING APPARATUS INCLUDING SAME

(75) Inventors: Hiroshi Yoshinaga, Chiba (JP); Kenichi Hasegawa, Kanagawa (JP); Masaaki Yoshikawa, Tokyo (JP); Kenji Ishii, Kanagawa (JP); Akira Shinshi, Machida (JP); Naoki Iwaya, Tokyo (JP); Yutaka Ikebuchi, Kanagawa (JP); Tetsuo Tokuda, Kanagawa (JP); Ippei Fujimoto, Kanagawa (JP); Yoshiki Yamaguchi, Kanagawa (JP); Takahiro Imada, Kanagawa (JP); Takamasa Hase, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 686 days.

(21) Appl. No.: 12/929,961

(22) Filed: Feb. 28, 2011

(65) Prior Publication Data

US 2011/0217056 A1 Sep. 8, 2011

(30) Foreign Application Priority Data

Mar. 4, 2010 (JP) ..... 2010-048254

(51) Int. Cl.
*G03G 15/20* (2006.01)

(52) U.S. Cl.
USPC ..... 399/33; 399/67; 399/69

(58) Field of Classification Search
USPC ..... 399/33, 69, 67
See application file for complete search history.

(56) References Cited

U.S. PATENT DOCUMENTS

| | | | | |
|---|---|---|---|---|
| 6,118,955 | A * | 9/2000 | Yoneda et al. | 399/69 |
| 6,131,009 | A | 10/2000 | Hasegawa | |
| 6,496,666 | B2 | 12/2002 | Hayashi et al. | |
| 6,591,081 | B2 | 7/2003 | Hasegawa | |
| 6,628,916 | B2 | 9/2003 | Yasui et al. | |

(Continued)

FOREIGN PATENT DOCUMENTS

| | | |
|---|---|---|
| CN | 1540456 | 10/2004 |
| CN | 101025600 | 8/2007 |

(Continued)

OTHER PUBLICATIONS

Abstracts of JP 2008-181048 and JP H04-044075.

*Primary Examiner* — David Gray
*Assistant Examiner* — Andrew Do
(74) *Attorney, Agent, or Firm* — Harness, Dickey & Pierce, P.L.C.

(57) ABSTRACT

A fixing device includes a substantially cylindrical metal member, a heater, an endless, flexible fixing member, a rotary pressing member, a stationary member, a first temperature detector, and a second temperature detector. The first temperature detector is disposed upstream from a nip in a rotation direction of the fixing member to detect a surface temperature of the fixing member. The second temperature detector is disposed downstream from the nip in a rotation direction of the pressing member to detect a surface temperature of the pressing member. When a difference between a surface temperature of the fixing member detected by the first temperature detector and a surface temperature of the pressing member detected by the second temperature detector after a predetermined time has elapsed since the first temperature detector detects the surface temperature of the fixing member is greater than a predetermined threshold, the heater stops heating the metal member.

7 Claims, 5 Drawing Sheets

(56) References Cited

U.S. PATENT DOCUMENTS

| | | | |
|---|---|---|---|
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,070,182 | B2 | 7/2006 | Hasegawa |
| 7,127,204 | B2 | 10/2006 | Satoh et al. |
| 7,151,907 | B2 | 12/2006 | Yoshinaga |
| 7,239,838 | B2 | 7/2007 | Sato et al. |
| 7,242,897 | B2 | 7/2007 | Satoh et al. |
| 7,313,353 | B2 | 12/2007 | Satoh et al. |
| 7,330,682 | B2 | 2/2008 | Shinshi |
| 7,379,698 | B2 | 5/2008 | Yoshinaga |
| 7,437,111 | B2 | 10/2008 | Yamada et al. |
| 7,454,151 | B2 | 11/2008 | Satoh et al. |
| 7,466,949 | B2 | 12/2008 | Satoh et al. |
| 7,509,085 | B2 | 3/2009 | Yoshinaga et al. |
| 7,515,850 | B2 | 4/2009 | Hasegawa |
| 7,546,049 | B2 | 6/2009 | Ehara et al. |
| 7,570,910 | B2 | 8/2009 | Ishii |
| 7,593,680 | B2 | 9/2009 | Shinshi |
| 7,630,652 | B2 | 12/2009 | Hasegawa |
| 7,702,271 | B2 | 4/2010 | Yamada et al. |
| 7,742,714 | B2 | 6/2010 | Shinshi et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,840,151 | B2 | 11/2010 | Fujimoto |
| 7,869,753 | B2 | 1/2011 | Shinshi |
| 2002/0009306 | A1 | 1/2002 | Hayashi et al. |
| 2002/0018663 | A1 | 2/2002 | Furukawa et al. |
| 2002/0044805 | A1 | 4/2002 | Hasegawa |
| 2002/0067936 | A1 | 6/2002 | Yasui et al. |
| 2003/0000933 | A1 | 1/2003 | Yoshinaga et al. |
| 2003/0007813 | A1 | 1/2003 | Yasui et al. |
| 2003/0016963 | A1 | 1/2003 | Yoshinaga et al. |
| 2003/0165348 | A1 | 9/2003 | Amita et al. |
| 2003/0206758 | A1 | 11/2003 | Yasui et al. |
| 2003/0215271 | A1 | 11/2003 | Yoshinaga et al. |
| 2004/0013453 | A1 | 1/2004 | Shinshi et al. |
| 2004/0178573 | A1 | 9/2004 | Hasegawa |
| 2004/0239749 | A1 | 12/2004 | Kagawa et al. |
| 2005/0025539 | A1 | 2/2005 | Yoshinaga |
| 2005/0074251 | A1 | 4/2005 | Katoh et al. |
| 2005/0095043 | A1 | 5/2005 | Yoshinaga et al. |
| 2005/0163543 | A1 | 7/2005 | Satoh et al. |
| 2005/0180786 | A1 | 8/2005 | Yamada et al. |
| 2006/0002737 | A1 | 1/2006 | Shinshi |
| 2006/0029411 | A1 | 2/2006 | Ishii et al. |
| 2006/0116230 | A1 | 6/2006 | Satoh et al. |
| 2006/0165429 | A1 | 7/2006 | Satoh et al. |
| 2006/0165443 | A1 | 7/2006 | Yoshinaga et al. |
| 2006/0165448 | A1 | 7/2006 | Yoshinaga |
| 2006/0257183 | A1 | 11/2006 | Ehara et al. |
| 2006/0285893 | A1 | 12/2006 | Ishii |
| 2007/0003334 | A1 | 1/2007 | Shinshi et al. |
| 2007/0014600 | A1 | 1/2007 | Ishii et al. |
| 2007/0014603 | A1 | 1/2007 | Satoh et al. |
| 2007/0059003 | A1 | 3/2007 | Shinshi et al. |
| 2007/0059071 | A1 | 3/2007 | Shinshi et al. |
| 2007/0077104 | A1 | 4/2007 | Hasegawa |
| 2007/0166085 | A1 | 7/2007 | Shinshi |
| 2007/0196120 | A1 | 8/2007 | Maeda |
| 2007/0217808 | A1 | 9/2007 | Maeda |
| 2007/0292175 | A1 | 12/2007 | Shinshi |
| 2008/0003009 | A1 | 1/2008 | Minakuchi et al. |
| 2008/0063443 | A1 | 3/2008 | Yoshinaga et al. |
| 2008/0112739 | A1 | 5/2008 | Shinshi |
| 2008/0175633 | A1 | 7/2008 | Shinishi |
| 2008/0219721 | A1 | 9/2008 | Ito et al. |
| 2008/0219730 | A1 | 9/2008 | Shinshi |
| 2008/0226326 | A1 | 9/2008 | Seo et al. |
| 2008/0232873 | A1 | 9/2008 | Ueno et al. |
| 2008/0253788 | A1 | 10/2008 | Shinshi |
| 2008/0253789 | A1 | 10/2008 | Yoshinaga et al. |
| 2008/0298862 | A1 | 12/2008 | Shinshi |
| 2008/0310862 | A1 | 12/2008 | Hasegawa |
| 2008/0317532 | A1 | 12/2008 | Ehara et al. |
| 2009/0003867 | A1 | 1/2009 | Fujimoto |
| 2009/0010687 | A1 | 1/2009 | Yamada et al. |
| 2009/0067902 | A1 | 3/2009 | Yoshinaga et al. |
| 2009/0123201 | A1 | 5/2009 | Ehara et al. |
| 2009/0123202 | A1 | 5/2009 | Yoshinaga et al. |
| 2009/0148204 | A1 | 6/2009 | Yoshinaga et al. |
| 2009/0148205 | A1 | 6/2009 | Seo et al. |
| 2009/0169232 | A1 | 7/2009 | Kunii et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2009/0311016 | A1 | 12/2009 | Shinshi |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290796 | A1* | 11/2010 | Sato ..... 399/33 |
| 2010/0290822 | A1 | 11/2010 | Hasegawa et al. |

FOREIGN PATENT DOCUMENTS

| | | | |
|---|---|---|---|
| CN | 101038476 | | 9/2007 |
| CN | 101097434 | | 1/2008 |
| CN | 101192040 | | 6/2008 |
| JP | 2884714 | A | 4/1999 |
| JP | 2001092303 | A | 4/2001 |
| JP | 2004021079 | A | 1/2004 |
| JP | 2006267941 | A * | 10/2006 |
| JP | 2007334205 | A | 12/2007 |
| JP | 2008158482 | A | 7/2008 |
| JP | 2009058773 | A | 3/2009 |
| JP | 4316625 | | 8/2009 |
| JP | 2009192720 | A | 8/2009 |

* cited by examiner

FIXING DEVICE AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-048254, filed on Mar. 4, 2010 in the Japan Patent Office, which is incorporated herein by reference in its entirety.

BACKGROUND

1. Field

Exemplary embodiments of the present disclosure relate to an image forming apparatus, such as a copier, a printer, a facsimile machine, or a multifunctional device having at least two of the foregoing capabilities, and a fixing device employed in the image forming apparatus.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

For example, a fixing device like that described in JP-2008-158482-A or JP-2007-334205-A includes a substantially-pipe-shaped metal member (opposed member) to effectively heat an endless fixing belt serving as a fixing member to shorten a warm-up time or a time to first print (hereinafter also "first print time"). Specifically, the metal member is provided inside a loop formed by the endless fixing belt so as to face a portion or the entire of the inner circumferential surface of the fixing belt. The metal member is heated by a built-in or external heater so as to heat the fixing belt. A pressing roller presses against the outer circumferential surface of the fixing belt at a position corresponding to the location of the metal member inside the loop formed by the fixing belt to form a nip between the fixing belt and the pressing roller through which the recording medium bearing the toner image passes. As the recording medium bearing the toner image passes through the nip, the fixing belt and the pressing roller apply heat and pressure to the recording medium to fix the toner image on the recording medium. For such a fixing device, when the pressing roller is rotated by a driving unit, the fixing belt in pressure contact with the pressing roller at the nip is rotated by friction resistance in accordance with the rotation of the pressing roller.

Alternatively, JP-2004-021079-A proposes an on-demand fixing device employing a ceramic heater to prevent overheating of a fixing belt when the fixing belt slips. The on-demand fixing device includes two temperature detectors to detect the temperature of the ceramic heater and stops heating of the ceramic heater when the difference between temperatures detected by the temperature detectors is equal to or greater than a predetermined threshold.

For the above-described fixing devices like those described in JP-2008-158482-A and JP-2007-334205-A, when a sufficient driving force is not transmitted from the pressing roller to the fixing belt, a slip (rotation failure) of the fixing belt may occur. Such a slip of the fixing belt may cause overheating at a portion of the fixing belt, thermally damaging the fixing belt. In particular, since the fixing device is highly efficient in heating the fixing belt, such a problem is not negligible. Further, the above-described fixing devices like those described in JP-2008-158482-A and JP-2007-334205-A employ a halogen heater as the heating unit. Such a configuration has a limitation in application of a technique of JP-2004-021079-A using the two temperature detectors to detect the temperature of the ceramic heater.

SUMMARY

In an aspect of this disclosure, there is provided an improved fixing device including a substantially cylindrical metal member, a heater, an endless, flexible fixing member, a rotary pressing member, a stationary member, a first temperature detector, and a second temperature detector. The heater is positioned to heat the metal member. The fixing member is disposed rotatably around the metal member. An inner circumferential surface of the fixing member is heated by the metal member to heat and fix a toner image. The rotary pressing member is disposed opposite and parallel to the metal member and pressed against an outer circumferential surface of the fixing member to form a nip between the rotary pressing member and the fixing member through which a recording medium bearing the toner image passes. The stationary member is disposed at an inner circumferential surface side of the fixing member and pressed by the rotary pressing member via the fixing member to form the nip. The first temperature detector is disposed upstream from the nip in a rotation direction of the fixing member to detect a surface temperature of the fixing member. The second temperature detector is disposed downstream from the nip in a rotation direction of the rotary pressing member to detect a surface temperature of the rotary pressing member. When a difference between a surface temperature of the fixing member detected by the first temperature detector and a surface temperature of the rotary pressing member detected by the second temperature detector after a predetermined time has elapsed since the first temperature detector detects the surface temperature of the fixing member is greater than a predetermined threshold, the heater stops heating the metal member.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
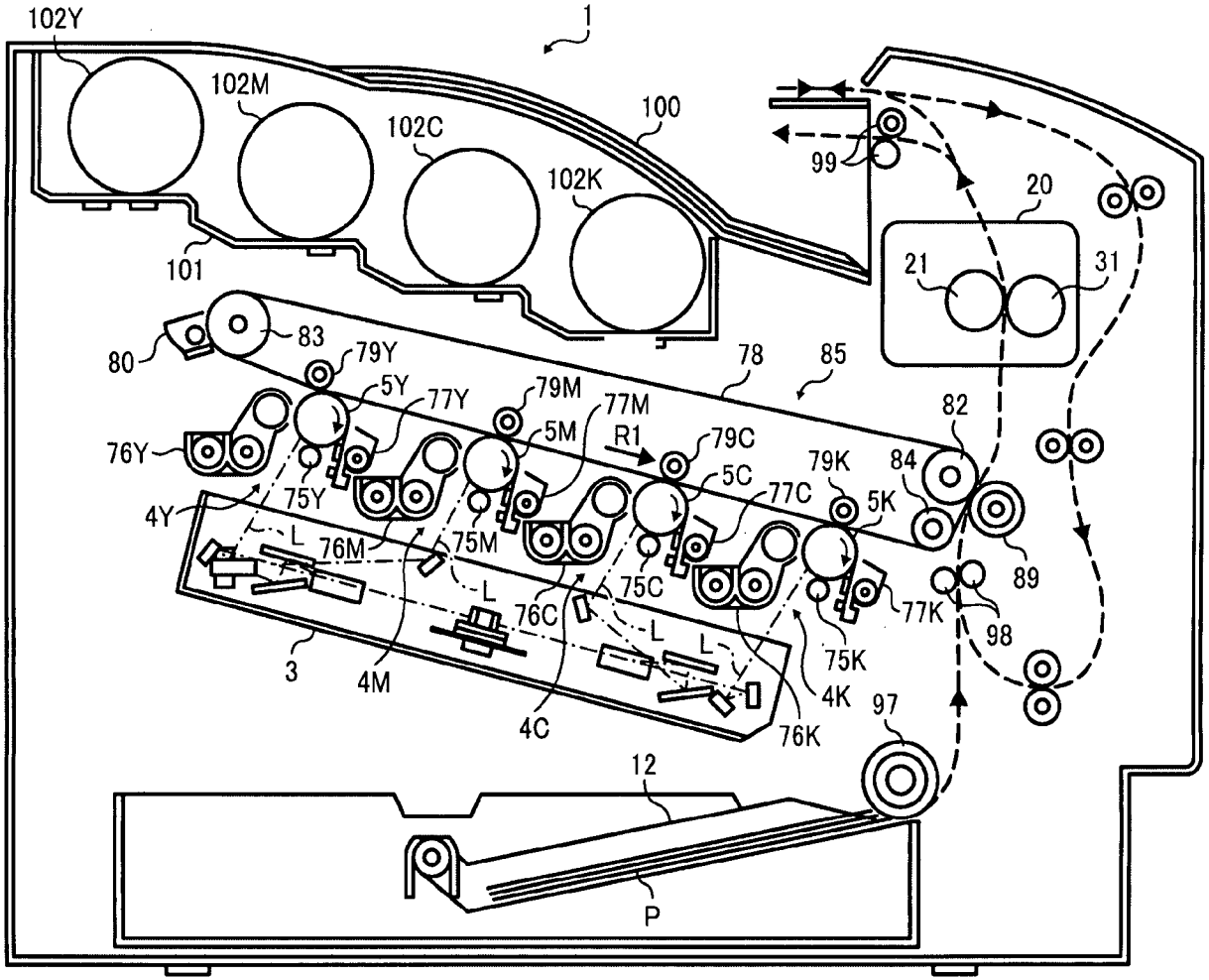
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, the term "width direction" refers to a direction perpendicular to a transport direction of a recording medium in a fixing device or an image forming apparatus.

The term "sheet pass area" refers to an area having a range of the recording medium in the width direction (perpendicular to the transport direction of the recording medium). By contrast, the term "non-sheet-pass area" refers to an area except the sheet pass area in the width direction.

The term "fixedly provided or mounted" state is refers to a state in which a stationary member, a metal member, or a reinforcement member described below is irrotationally held without being driven by, for example, a driving source. Accordingly, for example, even in a case in which the stationary member is urged by an urging member, such as a spring, toward a nip, if the stationary member is irrotationally held, the state of the stationary member is referred to as the "fixedly provided" state.

Referring now to the drawings, wherein like reference numerals designate identical or corresponding parts throughout the several views, exemplary embodiment of the present disclosure are described below.

An exemplary embodiment of the present disclosure is described with reference to FIGS. 1 to 8.

First, configuration and operation of an image forming apparatus 1 according to this exemplary embodiment are described with reference to FIG. 1.

In FIG. 1, the image forming apparatus 1 is a tandem color printer for forming a color image on a recording medium. However, it is to be noted that the image forming apparatus may be any other suitable type of image forming apparatus, such as a copier, a facsimile machine, a printer, or a multifunction printer having at least one of copying, printing, scanning, plotter, and facsimile functions. A toner bottle holder 1 is provided in an upper portion of the image forming apparatus 1. Four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively. An intermediate transfer unit 85 is provided below the toner bottle holder 101. Image forming devices 4Y, 4M, 4C, and 4K are arranged opposite an intermediate transfer belt 78 of the intermediate transfer unit 85, and form yellow, magenta, cyan, and black toner images, respectively.

The image forming devices 4Y, 4M, 4C, and 4K include photoconductive drums 5Y, 5M, 5C, and 5K, respectively. Further, chargers 75Y, 75M, 75C, and 75K, development devices 76Y, 76M, 76C, and 76K, cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75M, 75C, and 75K uniformly charge surfaces of the photoconductive drums 5Y, 5M, 5C, and 5K at charging positions at which the chargers 75M, 75C, and 75K are disposed opposite the photoconductive drums 5Y, 5M, 5C, and 5K, respectively.

In the exposure process, an exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the transfer process, first transfer bias rollers 5Y, 5M, 5C, and 5K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively.

In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The intermediate transfer unit 85 includes the intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed, on the intermediate transfer belt 78 reaches the second transfer nip. At the second transfer nip, a second transfer roller 89 and the second transfer backup roller 82 sandwich the intermediate transfer belt 78. The second transfer roller 89 transfers the color toner image formed on the intermediate transfer belt 78 onto the recording medium P fed by a registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78.

Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

A paper tray 12 is provided in a lower portion of the image forming apparatus 1, and loads a plurality of recording media P (e.g., transfer sheets). A feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing belt 21 and a pressing roller 31 apply heat and pressure to the recording medium P to fix the color toner image on the recording medium P. An output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

Referring to FIGS. 2 to 8, the following describes the structure and operation of the fixing device 20.

Figure 2:
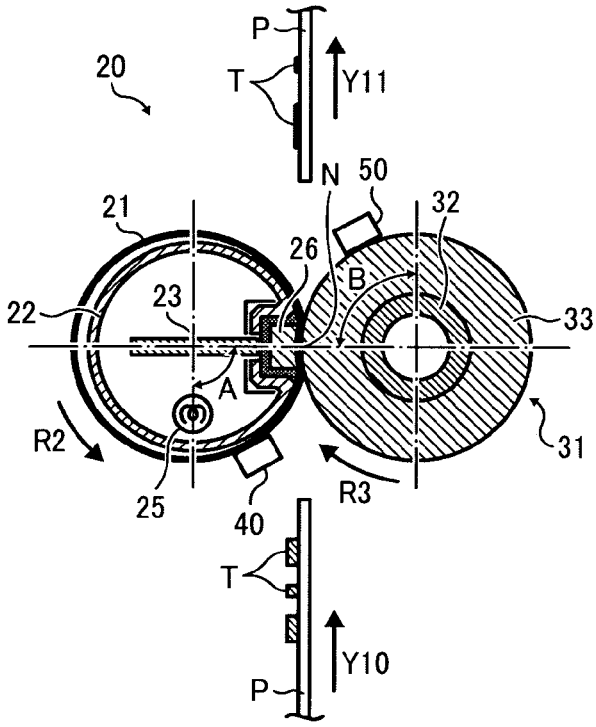
FIG. 2 is a sectional view of a fixing device of the image forming apparatus shown in FIG. 1.
Figure 3:
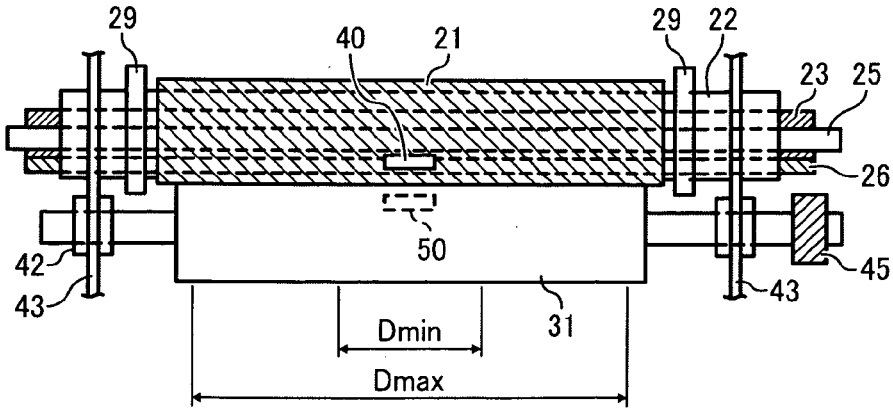
FIG. 3 is a plan view of the fixing device of FIG. 2 in a width direction thereof.
Figure 4:
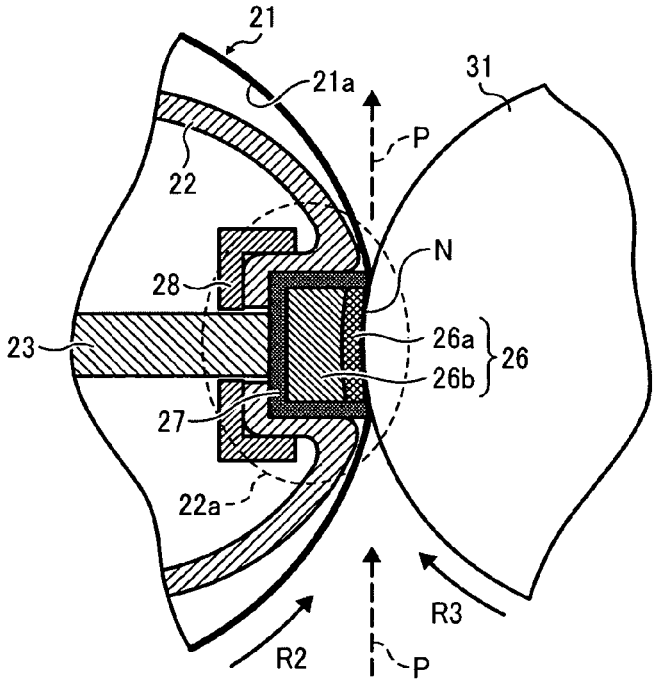
FIG. 4 is an enlarged view of a nip and its neighboring area of the fixing device of FIG. 2.

As illustrated in FIGS. 2 to 4, the fixing device 20 includes the fixing belt 21 serving as a fixing member, a stationary member 26, a metal member 22 serving as a heating member, a reinforcement member 23, a heater 25 serving as a heat source, the pressing roller 31 serving as a rotary pressing member, a first temperature sensor 40, a second temperature sensor 50, a heat insulator 27, and a stay 28.

The fixing belt 21 may be a thin, flexible endless belt that rotates or moves counterclockwise in FIG. 2, i.e., in a rotation direction R2 indicated by an arrow in FIG. 2. The fixing belt 21 is constructed of a base layer, an intermediate elastic layer, and a surface release layer, and has a total thickness not greater than approximately 1 mm. The base layer includes an inner circumferential surface 21*a* serving as a sliding surface which slides over the stationary member 26. The elastic layer is provided on the base layer. The release layer is provided on the elastic layer.

The base layer of the fixing belt 21 has a thickness in a range of from approximately 30 μm to approximately 50 μm, and includes a metal material such as nickel and/or stainless steel, and/or a resin material such as polyimide.

The elastic layer of the fixing belt 21 has a thickness in a range of from approximately 100 μm to approximately 300 μm, and includes a rubber material such as silicon rubber, silicon rubber foam, and/or fluorocarbon rubber. The elastic layer eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P, suppressing formation of a rough image such as an orange peel image. In this exemplary embodiment, the elastic layer of the fixing belt 21 is made of, for example, silicone rubber of a thickness of approximately 200 μm.

The release layer of the fixing belt 21 has a thickness in a range of from approximately 10 μm to approximately 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The diameter of the fixing belt 21 is set to approximately 15 mm to approximately 120 mm. In this exemplary embodiment, the fixing belt 21 has an inner diameter of, for example, approximately 30 mm. As illustrated in FIGS. 2 to 4, the stationary member 26, the heater 25, the metal member 22, the reinforcement member 23, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21. A lubricant intervenes between the fixing belt 21 and the metal member 22.

The stationary member 26 is fixed inside the fixing belt 21 in such a manner that the inner circumferential surface 21*a* of the fixing belt 21 slides over the stationary member 26. The stationary member 26 is pressed by the pressing roller 31 with the fixing belt 21 sandwiched between the stationary member 26 and the pressing roller 31 to form the nip N between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by the side plates 43 of the fixing device 20, respectively. The configuration of the stationary member 26 is described in more detail below.

As illustrated in FIG. 2, the metal member 22 has a substantially cylindrical shape. The metal member 22 serving as a heating member directly faces the inner circumferential surface 21*a* of the fixing belt 21 at a position other than the nip N. At the nip N, the metal member 22 holds the stationary member 26 via the heat insulator 27. As illustrated in FIG. 3, both ends of the metal member 22 in a width direction of the metal member 22 parallel to the Axial direction of the fixing belt 21 are mounted on and supported by the side plates 43 of the fixing device 20, respectively. The flanges 29 are provided on both ends of the metal member 22 in the width direction of the metal member 22 to restrict movement (e.g., shifting) of the fixing belt 21 in the axial direction of the fixing belt 21.

The substantially-cylindrical metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than approximately 0.1 mm to maintain desired heating efficiency for heating the fixing belt 21.

The metal member 22 may include a metal thermal conductor, that is, a metal having thermal conductivity, such as stainless steel, nickel, aluminum, and/or iron. Preferably, the metal member 22 may include ferrite stainless steel having a relatively smaller heat capacity per unit volume obtained by multiplying density by specific heat. In this exemplary embodiment, the metal member 22 includes, for example, SUS430 stainless steel as ferrite stainless steel and has a thickness of, for example, 0.1 mm.

The heater 25 may be a halogen heater and/or a carbon heater. As illustrated in FIG. 3, both ends of the heater 25 in a width direction of the heater 25 parallel to the axial direction of the fixing belt 21 are fixedly provided on the side plates 43 of the fixing device 20, respectively. Radiation heat generated by the heater 25, which is controlled by a power source provided in the image forming apparatus 1 depicted in FIG. 1, heats the metal member 22. The metal member 22 heats substantially the entire fixing belt 21. In other words, the metal member 22 heats a portion of the fixing belt 21 other than the nip N. Heat is transmitted from the heated outer circumferential surface of the fixing belt 21 to the toner image T on the recording medium P. As illustrated in FIG. 2, the first temperature sensor 40 serving as a first temperature detector, which may be a thermistor, faces the outer circumferential surface of the fixing belt 21 to detect a temperature of the outer circumferential surface of the fixing belt 21. A controller controls the heater 25 according to detection results provided by the first temperature sensor 40 so as to adjust the temperature (e.g., fixing temperature) of the fixing belt 21 to a desired temperature. It is to be noted that the controller as herein described is comprised of a central processing unit (CPU) with associated volatile and nonvolatile memory units (e.g., RAM, ROM), and controls the fixing device by executing one or more programs stored in the memory.

As described above, for the fixing device 20 according to this exemplary embodiment, the metal member 22 does not heat a small part of the fixing belt 21 but heats substantially the entire fixing belt 21 in a circumferential direction of the fixing belt 21. Accordingly, even when the image forming apparatus 1 depicted in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

The substantially-cylindrical metal member 22 is fixedly disposed opposite the fixing belt 21 in such a manner that a certain clearance is provided between the inner circumferential surface 21*a* of the fixing belt 21 and the metal member 22 over an area along the inner surface of the fixing belt 21 except for where the nip N is formed. The clearance δ, that is, a gap between the fixing belt 21 and the metal member 22 at the area along the inner surface of the fixing belt 21 other than the nip N, is not greater than 1 mm, expressed as $0\text{ mm} < \delta = < 1\text{ mm}$. Accordingly, the fixing belt 21 does not slidably contact the metal member 22 over an increased area, thus suppressing wearing of the fixing belt 21. At the same time, the clearance provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

A lubricant, such as fluorine grease or silicone oil, is applied between the inner circumferential surface 21*a* of the fixing belt 21 and the metal member 22, so as to decrease wearing of the fixing belt 21 as the fixing belt 21 slidably contacts the metal member 22.

In this exemplary embodiment, the metal member 22 has a cross section of a substantially circular shape. Alternatively, the metal member 22 may have a cross section of a polygonal shape.

As illustrated in FIG. 2, the reinforcement member 23 reinforces the stationary member 26 which forms the nip N between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly supported by the side plates 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip N. Specifically, as illustrated in FIG. 2, the reinforcement member 23 is a plate member that is disposed so as to divide the interior of the metal member 22 into substantially two spaces.

In order to provide the above-described capabilities, the reinforcement member 23 may include metal material having great mechanical strength, such as stainless steel and/or iron. In this exemplary embodiment, the reinforcement member 23 includes, for example, SUS304 (or SUS403) of a thickness of approximately 1.5 mm to approximately 2 mm.

Further, an opposing face of the reinforcement member 23 which faces the heater 25 may include a heat insulation material partially or wholly. Alternatively, the opposing face of the reinforcement member 23 disposed opposite the heater 25 may be mirror-ground. Accordingly, heat radiated by the heater 25 toward the reinforcement member 23 to heat the reinforcement member 23 is used to heat the metal member 22, improving heating efficiency for heating the metal member 22 and the fixing belt 21.

As illustrated in FIG. 2, the pressing roller 31 serves as a rotary pressing member for contacting and pressing against the outer circumferential surface of the fixing belt 21 at the nip N. The pressing roller 31 has an outer diameter of approximately 30 mm. In the pressing roller 31, an elastic layer 33 having a thickness of, for example, approximately 3 mm is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip N between the pressing roller 31 and the fixing belt 21. As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via the bearings 42, respectively.

When the elastic layer 33 of the pressing roller 31 includes a sponge material such as silicon rubber foam, the pressing roller 31 applies decreased pressure to the fixing belt 21 at the nip N to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

In this exemplary embodiment, the diameter of the fixing belt 21 is substantially identical to the diameter of the pressing roller 31. Alternatively, the diameter of the fixing belt 21 is may be smaller than the diameter of the pressing roller 31.

The fixing device 20 further includes the second temperature sensor 50, such as a thermistor, to detect the surface temperature of the pressing roller 31. The second temperature sensor 50 is used to detect a slip (rotation failure) of the fixing belt 21 along with the first temperature sensor 40, which is described below in detail.

In this exemplary embodiment, since the two temperature sensors 40 and 50 are used to detect a slip of the fixing belt 21, a heat source directly heating the pressing roller 31 (e.g., a heater within a metal core of the pressing roller 31) is not provided.

As illustrated in FIG. 4, the inner circumferential surface 21*a* of the fixing belt 21 slides over the stationary member 26. The stationary member 26 includes a surface layer 26*a* disposed on a base layer 26*b*. An opposing face (sliding-contact face) of the stationary member 26 facing the pressing roller 31 has a concave shape of a curvature substantially identical to the curvature of the pressing roller 31. Thus, the recording medium P is discharged from the nip N substantially along the curvature of the pressing roller 31, preventing a failure, such as non-separation of the recording medium P from the fixing belt 21 after the fixing process.

As described above, in this exemplary embodiment, the stationary member 26 forming the nip N has a concave shape. Alternatively, the stationary member 26 may have a flat shape. In other words, the sliding-contact surface of the stationary member 26 that opposes the pressing roller 31 may be formed in flat shape. For such a configuration, the shape of the nip is substantially parallel to an image recorded face of the recording medium P. As a result, the fixing belt 21 comes into closer contact with the recording medium P, thus enhancing fixing performance. In addition, the curvature of the fixing belt 21 is relatively large at the exit side of the nip, thus facilitating smooth separation of the recording medium P from the nip.

The base layer 26*a* of the stationary member 26 includes a rigid material so that the stationary member 26*b* is not bent substantially by pressure applied by the pressing roller 31. In this exemplary embodiment, the base layer 26*b* is made of, for example, aluminum of a thickness of approximately 1.5 mm. In this exemplary embodiment, the base layer 26*b* is made of, for example, aluminum of a thickness of approximately 1.5 mm.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip N, degrading fixing property. To address this problem, in this exemplary embodiment, the rigid stationary member 26 is provided separately from the thin metal member 22 to help form and maintain the proper nip N.

The surface layer 26*a* of the stationary member 26 is a low friction material such as fluorocarbon rubber. Such a configuration can form a desired nip between the stationary member 26 and the fixing belt 21 while suppressing wear of the fixing belt 21 and the stationary member 26 due to sliding contact of the stationary member 26 with the fixing belt 21. In this exemplary embodiment, the surface layer 26*a* has a thickness of approximately 1.5 and approximately 2 mm.

Further, the surface layer 26*a* may be preliminarily impregnated with the lubricant. Thus, the lubricant is retained at the surface of the stationary member 26 contacting the fixing belt 21, thus suppressing wearing of the stationary member 26 and the fixing belt 21.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

In this exemplary embodiment, the metal member 22 is disposed in proximity to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In conventional on-demand fixing devices, when heat is applied to the deformed pressing roller 31 at the nip N in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip N, generating faulting fixing or noise in accordance with rotation of the pressing roller 31.

To address those problems, according to this exemplary embodiment, the heat insulator 27 is provided between the stationary member 26 and the metal member 22 to reduce heat transmitted from the metal member 22 to the stationary member 26 in the standby mode, suppressing heating of the deformed pressing roller 31 at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip N, resulting in unstable slippage of the fixing belt 21 over the stationary member 26.

To address this problem, according to this exemplary embodiment, the heat insulator 27 is provided between the stationary member 26 and the metal member 22 to reduce heat transmitted from the metal member 22 to the lubricant at the nip N, thus reducing deterioration of the lubricant due to high temperature.

In this exemplary embodiment, the heat insulator 26 provided between the stationary member 26 and the metal member 22 insulates the stationary member 26 from the metal member 22. Accordingly, the metal member 22 heats the fixing belt 21 with reduced heat at the nip N. Consequently, the recording medium P discharged from the nip N has a decreased temperature compared to when the recording medium P enters the nip N. In other words, at the exit of the nip N, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion 22*a* of the metal member 22 into which the stationary member 26 is inserted so as to hold the metal member 22.

In this exemplary embodiment, a stainless steel sheet having a thickness of about 0.1 mm is bent into the substantially cylindrical metal member 22. However, spring-back of the stainless steel sheet may expand a circumference of the metal member 22, and therefore the stainless steel sheet may maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21. To address this problem, according to this exemplary embodiment, the stay 28 supports and holds the concave portion (bent portion) 22*a* of the metal member 22 provided with an opening so as to prevent deformation of the metal member 22 due to spring-back. For example, the stay 28 is press-fitted to the concave portion 22*a* of the metal member 22 to contact the inner circumferential surface of the metal member 22 while the shape of the metal member 22 that is bent against spring-back of the stainless steel sheet is maintained.

Preferably, the metal member 22 has a thickness not greater than approximately 0.2 mm to increase heating efficiency of the metal member 22.

As described above, the substantially cylindrical-shaped metal member 22 may be formed by bending sheet metal into the desired shape. Sheet metal is used to give the metal member 22 a thin thickness to shorten warm-up time. However, such a thin metal member 22 has little rigidity, and therefore may be easily bent or deformed by pressure applied by the pressing roller 31. Accordingly, the deformed metal member 22 may not provide a desired nip length of the nip N, resulting in degraded fixing property. To address this problem, according to this exemplary embodiment, the concave portion 22*a* of the thin metal member 22 into which the stationary member 26 is inserted is spaced away from the nip N to prevent the metal member 22 from receiving pressure from the pressing roller 31 directly.

The following describes operation of the fixing device 20 having the above-described structure. When the image forming apparatus 1 is powered on, power is supplied to the heater 25. Further, when a drive force from a drive motor is transmitted to the pressing roller 31, the pressing roller 31 starts rotating in the rotation direction R3. Thus, by friction between the pressing roller 31 and the fixing belt 21, the fixing belt 21 is rotated in the rotation direction R2 in accordance with the rotation of the pressing roller 31.

Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip N formed between the fixing belt 21 and the pressing roller 31 pressed against each other. At the nip N, the fixing belt 21 heated by the heater 25 via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip N is conveyed in a direction Y11.

Configuration and operation of a fixing device 20 according to an exemplary embodiment of the present disclosure are described below.

As illustrated in FIGS. 2 and 3, for the fixing device 20, the first temperature sensor 40 serving as a first temperature detector to detect the surface temperature of the fixing belt 21 is disposed downstream from the nip in the rotation direction R2 of the fixing belt 21. Further, the second temperature sensor 50 serving as a second temperature detector to detect the surface temperature of the pressing roller (rotary pressing member) 31 is disposed downstream from the nip in the rotation direction R3 of the pressing roller 31.

When a difference between a temperature detected by the first temperature sensor 40 (e.g., a temperature of the fixing belt 21 immediately before the fixing belt 21 enters the nip) and a temperature detected by the second temperature sensor 50 (e.g., a temperature of the pressing roller 31 immediately after the pressing roller 31 goes out of the nip) is greater than a predetermined threshold, the controller controls the heater 25 to stop heating the metal member 22. At this time, the second temperature sensor 50 detects the temperature of the pressing roller 31 after a predetermined time has elapsed since the first temperature sensor 40 detects the temperature of the fixing belt 21.

For example, the first temperature sensor 40 detects the surface temperature of the fixing belt 21 rotating in the direction R2 of FIG. 2 constantly (or at predetermined intervals), and the second temperature sensor 50 detects the surface temperature of the pressing roller 31 rotating in the direction R3 constantly (or at predetermined intervals). If a difference between a temperature detected by the first temperature sensor 40 and a temperature detected by the second temperature sensor 50 after a predetermined time has elapsed since the first temperature sensor 40 detects the temperature of the fixing belt 21 is greater than a predetermined threshold, the controller determines that a slip (rotation failure) of the fixing belt 21 has occurred, and cuts power supply from a power unit to the heater 25 to prevent overheating of the fixing belt 21. Specifically, the above-described predetermined time is set so that the second temperature sensor 50 can detect the surface temperature of a portion of the pressing roller 31 heated by a portion of the fixing belt 21 detected by the first temperature sensor 40. Such a configuration can prevent localized overheating of a portion of the fixing belt 21 (in particular, a portion opposing the heater 25) even if a slip of the fixing belt 21 occurs.

To achieve the above-described control, as described below, when the fixing belt 21 normally rotates without slipping, heat from the fixing belt 21 is preferably transferred to the pressing roller 31 at a substantially constant rate (or proportionally), regardless of whether a recording medium is passing through the nip or not.

For example, if the above-described temperature difference greater than the predetermined threshold is detected sequentially more than a predetermined number of times (or over a predetermined time period), the controller determines that the fixing device is out of order, and controls the image forming apparatus 1 to stop image formation and display a message indicating the out-of-order state or prompting servicing. Such a configuration can prevent fixing failure of an output image caused by temperature decrease of the fixing belt 21 at the nip or transport failure of the recording medium P caused by rotation failure of the fixing belt 21.

By contrast, if the above-described temperature difference greater than the predetermined threshold is not detected sequentially more than a predetermined number of times (i.e., the temperature difference returns to a normal value within the predetermined number of times), the power unit starts supplying power to the heater 25 again to heat the metal member 22. Such a configuration can suppress frequent occurrences of downtime of the image forming apparatus 1 while simultaneously preventing overheating of the fixing belt 21.

As illustrated in FIG. 2, in a cross section perpendicular to the axial direction of the fixing belt 21, the first temperature sensor 40 is disposed within a circumferential range of 90 degrees (indicated by a double arrow A) upstream from the nip in the rotation direction R2 of the fixing belt 21. Meanwhile, in a cross section perpendicular to the axial direction of the pressing roller 31, the second temperature sensor 50 is disposed within a circumferential range of 90 degrees (indicated by a double arrow B) downstream from the nip in the rotation direction R3 of the pressing roller 31.

Such a configuration can reduce errors in detecting the surface temperature of the fixing belt 21 immediately before the fixing belt 21 enters the nip and the surface temperature of the pressing roller 31 immediately after the pressing roller 31 passes through the nip. Thus, the slip of the fixing belt 21 can be accurately detected.

It is to be noted that, even if the layout of the fixing device 20 and the image forming apparatus 1 prevents the first temperature sensor 40 and/or the second temperature sensor 50 from being disposed within the above-described range, the slip of the fixing belt 21 can be detected if the first temperature sensor 40 and the second temperature sensor 50 are disposed within a range in which the temperature of the fixing belt 21 detected upstream from the nip in the rotation direction R2 of the fixing belt 21 can be associated with the temperature of the pressing roller 31 detected downstream from the nip in the rotation direction R3 of the pressing roller 31.

For example, if the outer diameter and rotation speed of the fixing belt 21 are equivalent to those of the pressing roller 31, the first temperature sensor 40 and the second temperature sensor 50 are disposed so that the circumferential distance from the detection position of the first temperature sensor 40 to the nip (i.e., a central position of the nip) is equivalent to the circumferential distance from the nip (i.e., the central position of the nip) to the detection position of the second temperature sensor 50.

In this exemplary embodiment, as illustrated in FIG. 3, the first temperature sensor 40 and the second temperature sensor 50 are disposed so that the detection position of the first temperature sensor 40 corresponds to the detection position of the second temperature sensor 50 in the axial direction of the fixing belt 21 (e.g., a horizontal direction in FIG. 3). Such a configuration allows the temperature of the fixing belt 21 detected upstream from the nip to be accurately associated with the temperature of the pressing roller 31 detected downstream from the nip, thus enhancing the accuracy in detecting the slip of the fixing belt 21.

As illustrated in FIG. 3, the first temperature sensor 40 and the second temperature sensor 50 are disposed so that the axial detection positions of the first temperature sensor 40 and the second temperature sensor 50 is within an axial range of any of sheet pass areas over which recording media P of different compatible sizes pass. For example, for this exemplary embodiment, in the fixing device 20, recording media P of all sizes necessarily pass through the nip using the central position of the nip as a reference position (i.e., with the axial central position of the recording medium P aligned with the axial central position of the fixing belt 21). The detection positions of the first temperature sensor 40 and the second temperature sensor 50 are determined so as to be within an axial range of any of sheet pass areas over which recording media P of different compatible sizes pass, from a minimum sheet pass area Dmin of a recording medium P of a minimum compatible size to a maximum sheet pass area Dmax of a recording medium P of a maximum compatible size.

With such a configuration, even if the recording media P of different sizes pass through the nip, the temperature of the fixing belt 21 detected upstream from the nip can be accurately associated with the temperature of the pressing roller 31 detected downstream from the nip, thus enhancing the accuracy in detecting the slip of the fixing belt 21.

For this exemplary embodiment, the above-described detection of the slip of the fixing belt 21 and control operations involving the detection are performed not only when a recording medium P passes through the nip (i.e., when fixing process is performed at the nip) but also in a warm-up time or a non-sheet-passing period, such as intervals between a plurality of recording media P during sequential sheet feeding, in which, with the heater 25 being powered on, the fixing belt 21 and the pressing roller 31 are rotated without performing fixing process. For this exemplary embodiment, a predetermined threshold for non-sheet-passing period is set smaller than a predetermined threshold for sheet passing period (which is a difference between temperatures detected by the first temperature sensor 40 and the second temperature sensor 50 to determine whether the slip of the fixing belt 21 is in occurrence. As described below in more detail, this is because the amount of heat transferred from the fixing belt 21 to the pressing roller 31 is different between sheet passing period and non-sheet-passing period although the amount of heat is transferred from the fixing belt 21 to the pressing roller 31 at a substantially constant rate (or proportionally) between sheet passing period and non-sheet-passing period. In particular, in the warm-up time, unlike the sheet passing period, the difference between temperatures detected by the first temperature sensor 40 and the second temperature sensor 50 increases proportionally with time from the activation. Therefore, it is preferable to use the elapsed time from the activation as a control parameter. Such configuration and control allows accurate detection of the slip of the fixing belt 21 in both the sheet passing period and the non-sheet-passing period.

With reference to experimental data of FIGS. 5 to 8, effects obtained by this exemplary embodiment are further described below.

Figure 5:
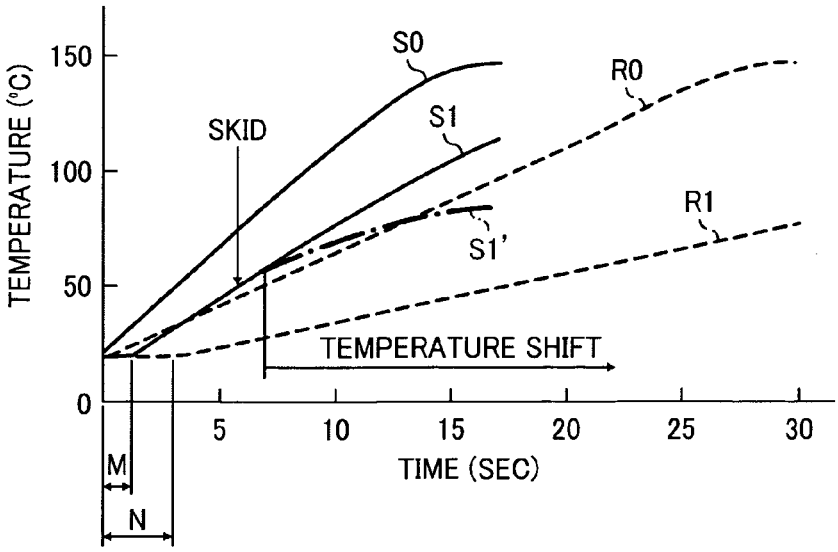
FIG. 5 is a graph showing temperature fluctuations of a fixing belt and a pressing roller during a warm-up time.

FIG. 5 is a graph showing temperature fluctuations of the fixing belt 21 and the pressing roller 31 in a warm-up time.

In FIG. 5, line S0 shows a fluctuation in temperature of the fixing belt 21 in the fixing device 20 according to this exemplary embodiment, which is a temperature profile detected by the first temperature sensor 40 in the warm-up time, and line S1 shows a fluctuation in temperature of the pressing roller 31 in the fixing device 20 according to this exemplary embodiment, which is a temperature profile detected by the second temperature sensor 50 in the warm-up time. Line S1' shows a fluctuation in temperature of the pressing roller 31 in the fixing device 20 according to this exemplary embodiment, which is a temperature profile detected by the second temperature sensor 50 when the slip of the fixing belt 21 occurs.

A line R0 shows a fluctuation in temperature of a fixing belt in a conventional belt-type fixing device, which is a temperature profile detected by a first temperature sensor in an warm-up time, and a line R1 shows a fluctuation in temperature of a pressing roller in the conventional belt-type fixing device, which is a temperature profile detected by a second temperature sensor in the warm-up time.

As illustrated in FIG. 5, the conventional belt-type fixing device is slower in raising the temperature of the fixing belt than the fixing device 20 according to this exemplary embodiment. Consequently, as illustrated in the line R0, the output of the first temperature sensor shows a longer time required for start-up. As a result, the amount of heat transferred from the fixing belt to the pressing roller decreases over time. Further, since the distance from the pressing roller including the heater to the nip is long, as illustrated in the line R1, the slope of the output of the second temperature sensor becomes less steep, resulting in a longer delay N in starting up.

By contrast, since the fixing device 20 according to the fixing device 20 is faster in raising the temperature of the fixing belt 21 than the conventional fixing device, as illustrated in the line S0, the slope of the output of the first temperature sensor 40 is greater. As a result, the amount of heat transferred from the fixing belt 21 to the pressing roller 31 increases over time. Further, since the heater 25 is disposed opposing the fixing belt 21 (and the metal member 22) at an area upstream from the nip N, as illustrated in the line S1, the slope of the output of the second temperature sensor 50 becomes steep, resulting in a shorter delay M (M<N) in starting up.

As described above, for the fixing device 20 according to the fixing device 20, the temperature rising of the fixing belt 21 is steep, the distance from a major heating point of the fixing belt 21 (close to the heater 25) to the nip is short, and the amount of heat transferred from the fixing belt 21 to the pressing roller 31 is relatively great. Such a configuration allows detection of the slip of the fixing belt 21 based on the above-described distance between temperatures detected by the first temperature sensor 40 and the second temperature sensor 50.

As illustrated in FIG. 5, for the fixing device 20 according to this exemplary embodiment, when a slip of the fixing belt 21 occurs, the amount of heat transferred from the fixing belt 21 to the pressing roller 31 decreases. As a result, as illustrated by the line S1', the slope of the temperature profile of the pressing roller 31 becomes less steep than the temperature profile of the pressing roller 31 in normal operation of the fixing belt 21 illustrated by the line S1. Further, after the occurrence of the slip of the fixing belt 21, as the rotation time (operation time) increases, the difference between the line S0 and the line S1' becomes greater than the difference between the line S0 and the line S1.

Specifically, in FIG. 5, the temperature slope of the line S0 is 9.2 deg/sec and the temperature slope of the line S1 is 5.8 deg/sec. Since the distance from each of the first temperature sensor 40 and the second temperature sensor 50 to the nip is short, little fluctuation is created in the temperature slopes of S0 and S1 by environmental factors. Accordingly, by comparing a predetermined threshold with differences over time between temperatures detected by the first temperature sensor 40 and the second temperature sensor 50, the occurrence of the slip of the fixing belt 21 can be reliably detected.

For this exemplary embodiment, in consideration of the delay M in the output of the second temperature sensor 50 at the start of warm-up operation (which is caused since no heat is transferred from the fixing belt 21 to the pressing roller 31), detection of the slip of the fixing belt 21 is not performed during the time corresponding to the delay M.

Figure 6:
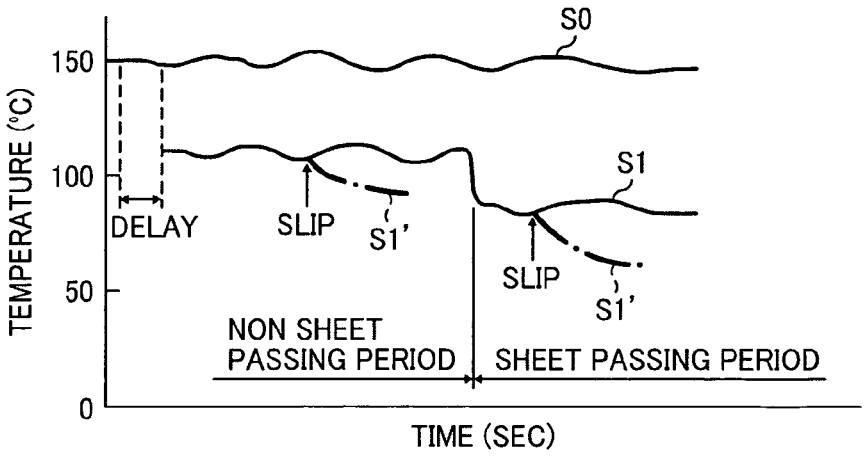
FIG. 6 is a graph showing temperature fluctuations of the fixing belt and the pressing roller from a non-sheet-passing period to a sheet passing period.
Figure 7:
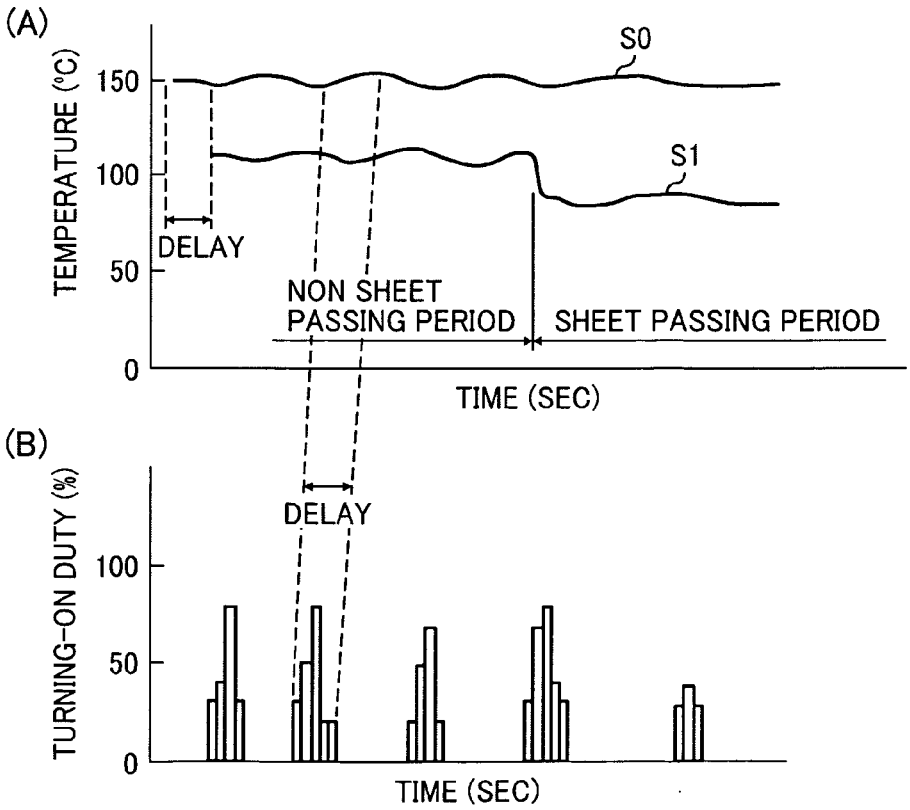
FIG. 7A is a graph showing temperature fluctuations of the fixing belt and the pressing roller from a non-sheet-pass period to a sheet passing period.
FIG. 7B is a graph showing a duty cycle of the heater.

FIG. 6 is a graph showing temperature fluctuations of the fixing belt 21 and the pressing roller 31 when the fixing device 20 shifts from a non-sheet-passing period to a sheet passing period.

In FIG. 6, a graph S0 shows a fluctuation in temperature of the fixing belt 21 in the fixing device 20 according to this exemplary embodiment, which is a temperature profile of the first temperature sensor 40. A graph S1 shows a fluctuation in temperature of the pressing roller 31 in the fixing device 20 according to this exemplary embodiment, which is a temperature profile of the second temperature sensor 50. A graph S1' shows a fluctuation in temperature of the pressing roller 31 in the fixing device 20 according to this exemplary embodiment, which is a temperature profile detected by the second temperature sensor 50 when the slip of the fixing belt 21 occurs. It is to be noted that, unlike the non-sheet-passing period (warm-up time) of FIG. 5, the non-sheet-passing period of FIG. 6 represents a state in which the temperature of the fixing belt 21 is maintained substantially constant (after warm-up) as in, for example, intervals between a plurality of recording media P during sequential sheet feeding. For example, for this exemplary embodiment, the surface temperature of the fixing belt 21 is controlled to be 150° C. In the sheet passing period, the surface temperature of the pressing roller 31 is maintained at substantially 90° C., and in the non-sheet-passing period, the surface temperature of the pressing roller 31 is maintained at substantially 110° C. It is to be noted that FIG. 6 shows an experimental result observed when recording media P of 70 $g/m^2$ sequentially pass through the nip.

As illustrated in FIG. 6, even in the sequential sheet passing of the recording media P, as with the case of the warm-up period illustrated in FIG. 5, if the slip of the fixing belt 21 occurs, the amount of heat transferred from the fixing belt 21 to the pressing roller 31 decreases, resulting in a reduction in temperature of the pressing roller 31 as compared to the temperature profile of the pressing roller 31 in normal operation of the fixing belt 21. Accordingly, by comparing a predetermined threshold with differences between temperatures detected by the first temperature sensor 40 and the second temperature sensor 50, the occurrence of the slip of the fixing belt 21 can be detected.

As illustrated in FIG. 6, regardless of whether or not the slip of the fixing belt 21 occurs, the difference (temperature shift) between temperatures detected by the first temperature sensor 40 and the second temperature sensor 50 in the sheet passing period is greater than that in the non-sheet-passing period. Hence, for this exemplary embodiment, the predetermined threshold for the non-sheet-passing period is set smaller than the predetermined threshold for the sheet passing period (which is a difference between temperatures detected by the first temperature sensor 40 and the second temperature sensor 50 to determine whether the slip of the fixing belt 21 is in occurrence. Such configuration allows accurate detection of the slip of the fixing belt 21 in both the sheet passing period and the non-sheet-passing period, thus preventing overheating of the fixing belt 21.

The above-described detection of the slip of the fixing belt 21 may not be performed immediately before and after switching from the non-sheet-passing period to the sheet passing period. This is because fluctuations in the timing at which a leading edge of a recording medium P enters the nip might result in fluctuations in the difference between temperatures detected by the first temperature sensor 40 and the second temperature sensor 50 before and after switching from the non-sheet-passing period to the sheet passing period. The timing of switching between the non-sheet-passing period and the sheet passing period can be calculated from a timing at which the recording medium P starts to be fed from the registration roller pairs 98, a transport distance from the registration roller pairs 98 to the nip of the fixing device 20, and a transport speed (process linear velocity) of the recording medium P.

FIG. 7A is a graph showing temperature fluctuations of the fixing belt 21 and the pressing roller 31 observed when the fixing device 20 shifts from a non-sheet-pass period to a sheet passing period. FIG. 7B is a graph showing a duty cycle (of the turning on/off) of the heater 25.

For the control of the heater 25A, as illustrated in FIG. 7B, the control of the duty cycle (on/off control) is performed. As a result, as illustrated in FIG. 7A, minute ripples arise in the temperature fluctuation of the fixing belt 21 with delay from timings of the control of the duty cycle. Such temperature ripples of the fixing belt 21 affects the temperature fluctuation of the pressing roller 31 receiving heat from the fixing belt 21. Hence, the above-described slip detection of the fixing belt 21 may be performed in consideration of the timing of the control of the duty cycle. For example, the slip detection of the fixing belt 21 may be performed only when the turning-on/off duties are at a predetermined value (for example, 70%). Such a configuration can finely adjust conditions of the fixing belt 21 (the metal member 22) heated by the heater 25, thus enhancing the accuracy in detecting the slip of the fixing belt 21.

Figure 8:
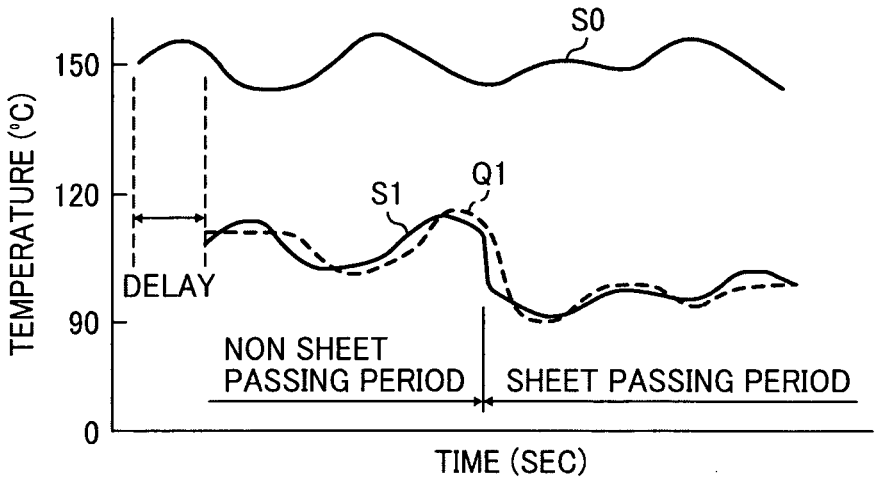
FIG. 8 is a graph showing temperature profiles of the fixing belt and the pressing roller observed when a second temperature sensor has different axial positions.

FIG. 8 is a graph showing temperature profiles of the fixing belt 21 and the pressing roller 31 observed when the second temperature sensor 50 has different axial positions.

Graphs S0 and S1 of FIG. 8 correspond to the graphs S0 and S1, respectively, of FIG. 6. The first temperature sensor 40 and the second temperature sensor 50 outputting the graphs S0 and S1, respectively, are disposed at positions corresponding to respective (axial) center positions of the fixing belt 21 and the pressing roller 31. In other words, the graph S1 shows a temperature profile of the second temperature sensor 50 disposed at a position corresponding to an axial center position of the sheet pass area of the pressing roller 31. In this case, the axial position of the second temperature sensor matches an axial position of the first temperature sensor 40. By contrast, a graph Q1 shows a temperature profile of the second temperature sensor 50 disposed at a position corresponding to an axial end portion of the sheet pass area of the pressing roller 31. In this case, the axial position of the second temperature sensor does not match the axial position of the first temperature sensor 40.

FIG. 8 shows that the graph S0 and the graph S1 have similar, if not the same, shapes of temperature profiles with a temporal delay, and the graph S0 and the graph Q1 have different shapes of temperature profiles. This is because the thickness and/or surface irregularities of the fixing belt 21 fluctuate with the axial position thereof. Such fluctuation may act as noise in detecting a slip of the fixing belt 21, thus resulting in reduced detection accuracy. Hence, as described above, the first temperature sensor 40 and the second temperature sensor 50 are disposed at an axially identical position, thus enhancing the accuracy of detecting the slip of the fixing belt 21.

As described above, for this exemplary embodiment, the fixing device 20 includes the first temperature sensor 40 serving as a first temperature detector to detect a surface temperature of the fixing belt 21 at a position upstream from the nip in the rotation direction R2 of the fixing belt 21 and the second temperature sensor 50 serving as a second temperature detector to detect a surface temperature of the pressing roller (rotary pressing member) 31 at a position downstream from the nip in the rotation direction R3 of the pressing roller 31. When the difference between temperatures detected by the first temperature sensor 40 and the second temperature sensor 50 is greater than a predetermined threshold, the heater 25 stops heating the metal member 22. Such a configuration can prevent fixing failures, such as uneven fixed image, while achieving a reduced warm-up time and/or first print time. In addition, even if a slip of the fixing belt 21 occurs, overheating of the fixing belt 21 can be prevented.

As described above, in this exemplary embodiment, the first temperature sensor 40 and the second temperature sensor 50 are contact-type thermistors. However, it is to be noted that the first temperature sensor 40 and the second temperature sensor 50 are not limited to such contact-type thermistors. For example, at least one of the first temperature sensor 40 and the second temperature sensor 50 may be a non-contact-type thermistor or temperature sensor (e.g., thermopile). Such a configuration can obtain effects equivalent to the above-described effects.

Next, another exemplary embodiment of the present disclosure is described with reference to FIG. 9.

Figure 9:
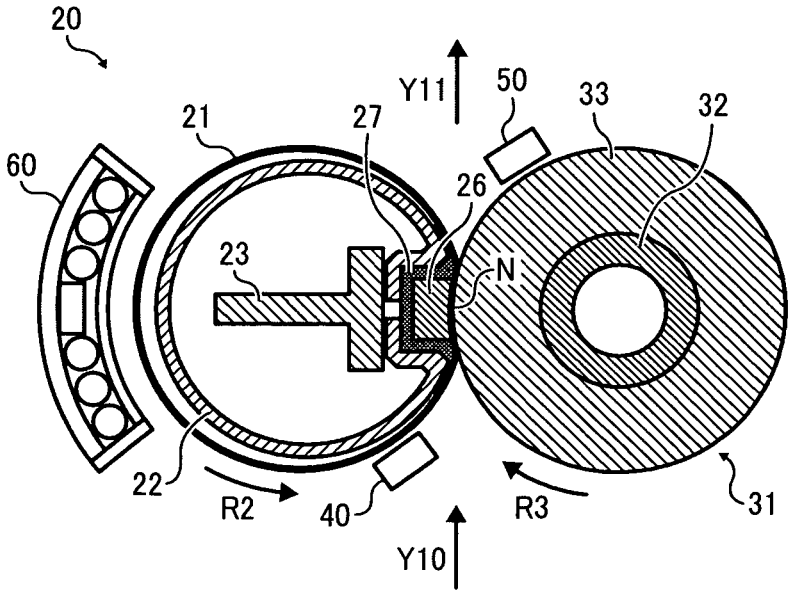
FIG. 9 is a sectional view of a fixing device according to an exemplary embodiment of the present disclosure.

FIG. 9 is a perspective view of a fixing device 20 in this exemplary embodiment. For the fixing device 20 illustrated in FIG. 9, the metal member 22 is heated by electromagnetic induction, which differs from the fixing device illustrated in 2.

As with the fixing device illustrated in FIG. 2, the fixing device 20 illustrated in FIG. 9 also includes a fixing belt 21 serving as a belt member, a stationary member 26, a metal member 22 of a substantially cylindrical shape, a reinforcement member 23, a heat insulator 27, a pressing roller 31 serving as a rotary pressing member, a first temperature sensor 40 serving as a first temperature detector, and a second temperature sensor 50 serving as a second temperature detector. Further, as with the fixing device illustrated in FIG. 2, the fixing device 20 illustrated in FIG. 9 also stops heating the metal member 22 when the difference between temperatures detected by the first temperature sensor 40 and the second temperature sensor 50 is greater than a predetermined threshold. For this exemplary embodiment, the first temperature sensor 40 and the second temperature sensor 50 are non-contact-type thermopiles.

The fixing device 20 includes an induction heater 60 as a heating unit, instead of the heater 25 illustrated in FIG. 2. In the above-described fixing device 20 illustrated in FIG. 2, radiation heat generated by the heater 25 heats the metal member 22. By contrast, in the fixing device 20 illustrated in FIG. 9, the induction heater 60 heats the metal member 22 by electromagnetic induction.

The induction heater 60 includes an exciting coil, a core, and a coil guide. The exciting coil includes litz wires formed of a bundle of thin wires, which extend in the axial direction of the fixing belt 21 (e.g., a direction perpendicular to a surface of a sheet on which FIG. 9 is printed) to cover a part of the fixing belt 21. The coil guide includes heat-resistant resin and holds the exciting coil and the core. The core is a semi-cylindrical member including a ferromagnet having a relative magnetic permeability in a range of from approximately 1,000 to approximately 3,000, such as ferrite. The core includes a center core and a side core to generate magnetic fluxes toward the metal member 22 effectively. The core is disposed opposite the exciting coil extending in the width direction of the fixing belt 21.

Operation of the fixing device 20 having the above-described structure is described below.

The induction heater 60 heats the fixing belt 21 rotating in the rotation direction R2 at a position at which the fixing belt 21 faces the induction heater 60. Specifically, a high-frequency alternating current is applied to the exciting coil to generate magnetic lines of force around the metal member 22 in such a manner that the magnetic lines of force are alternately switched back and forth. Accordingly, an eddy current is generated on the surface of the metal member 22, and electric resistance of the metal member 22 generates Joule heat. The Joule heat heats the metal member 22 by electromagnetic induction, and the heated heating member 22 heats the fixing belt 21.

In order to heat the metal member 22 effectively by electromagnetic induction, the induction heater 60 may face the metal member 22 in an entire circumferential direction of the metal member 22. The metal member 22 may include nickel, stainless steel, iron, copper, cobalt, chrome, aluminum, gold, platinum, silver, tin, palladium, and/or an alloy of a plurality of those metals, or the like.

As described above, the fixing device 20 according to this exemplary embodiment also includes the first temperature sensor 40 serving as a first temperature detector to detect a surface temperature of the fixing belt 21 at a position upstream from the nip in the rotation direction R2 of the fixing belt 21 and the second temperature sensor 50 serving as a second temperature detector to detect a surface temperature of the pressing roller (rotary pressing member) 31 at a position downstream from the nip in the rotation direction R3 of the pressing roller 31. When the difference between temperatures detected by the first temperature sensor 40 and the second temperature sensor 50 is greater than a predetermined threshold, the induction heater 60 stops heating the metal member 22. Such a configuration can prevent fixing failures, such as uneven fixed image, while achieving a reduced warm-up time and/or first print time. In addition, even if a slip of the fixing belt 21 occurs, overheating of the fixing belt 21 can be prevented.

As described above, for the fixing device 20 illustrated in FIG. 9, the induction heater 60 heats the metal member 22 by electromagnetic induction. Alternatively, a resistance heat generator may heat the metal member 22. For example, the resistance heat generator may contact an inner circumferential surface of the metal member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases the temperature of the resistance heat generator. Accordingly, the resistance heat generator heats the metal member 22 contacted by the resistance heat generator. Consequently, the heated metal member 22 heats the fixing belt 21.

Even in such a configuration, the controller stops heating the metal member 22 when the difference between temperatures detected by the first temperature sensor 40 and the second temperature sensor 50 at adequate timings adjusted in the same manner as the above-described exemplary embodiment is greater than a predetermined threshold, thus obtaining effects equivalent to those of the above-described exemplary embodiment.

In each of the above-described exemplary embodiments, a fixing belt having the multi-layer structure is used as the fixing belt 21. Alternatively, an endless fixing film including polyimide, polyamide, fluorocarbon resin, and/or metal may be used as a fixing belt to provide effects equivalent to the effects provided by the fixing device 20 described above.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a substantially cylindrical metal member;

a heater positioned to heat the metal member;

an endless, flexible fixing member disposed rotatably around the metal member, an inner circumferential surface of the fixing member being heated by the metal member to heat and fix a toner image;

a rotary pressing member disposed opposite and parallel to the metal member and pressed against an outer circumferential surface of the fixing member to form a nip between the rotary pressing member and the fixing member through which a recording medium bearing the toner image passes;

a stationary member disposed at an inner circumferential surface side of the fixing member and pressed by the rotary pressing member via the fixing member to form the nip;

a first temperature detector disposed upstream from the nip in a rotation direction of the fixing member to detect a surface temperature of the fixing member; and a second temperature detector disposed downstream from the nip in a rotation direction of the rotary pressing member to detect a surface temperature of the rotary pressing member, wherein, when a difference between a surface temperature of the fixing member detected by the first temperature detector and a surface temperature of the rotary pressing member detected by the second temperature detector after a predetermined time has elapsed since the first temperature detector detects the surface temperature of the fixing member is greater than a predetermined threshold, the heater stops heating the metal member.

2. The fixing device according to claim 1, wherein, when the recording medium does not pass through the nip, the predetermined threshold is set smaller than when the recording medium passes through the nip.

3. The fixing device according to claim 1, wherein an axial detection position of the first temperature detector is the same as an axial detection position of the second temperature detector.

4. The fixing device according to claim 1, wherein the axial detection position of the first temperature detector and the axial detection position of the second temperature detector are disposed within an axial range of any of sheet pass areas through which recording media of different sizes compatible with the fixing device pass.

5. The fixing device according to claim 1, wherein the first temperature detector is disposed within a circumferential range of 90 degrees upstream from the nip in a cross section perpendicular to an axial direction of the fixing member and the second temperature detector is disposed within a circumferential range of 90 degrees downstream from the nip in a cross section perpendicular to an axial direction of the pressing member.

6. The fixing device according to claim 1, further comprises a reinforcement member fixedly disposed within the metal member to reinforce the stationary member, wherein the metal member is disposed opposing the inner circumferential surface of the fixing member over an area other than the nip.

7. An image forming apparatus comprising a fixing device, the fixing device comprising:

a substantially cylindrical metal member;

a heater positioned to heat the metal member;

an endless, flexible fixing member disposed rotatably around the metal member, an inner circumferential surface of the fixing member being heated by the metal member to heat and fix a toner image;

a rotary pressing member disposed opposite and parallel to the metal member and pressed against an outer circumferential surface of the fixing member to form a nip between the rotary pressing member and the fixing member through which a recording medium bearing the toner image passes;

a stationary member disposed at an inner circumferential surface side of the fixing member and pressed by the rotary pressing member via the fixing member to form the nip;

a first temperature detector disposed upstream from the nip in a rotation direction of the fixing member to detect a surface temperature of the fixing member; and a second temperature detector disposed downstream from the nip in a rotation direction of the rotary pressing member to detect a surface temperature of the rotary pressing member, wherein, when a difference between a surface temperature of the fixing member detected by the first temperature detector and a surface temperature of the rotary pressing member detected by the second temperature detector after a predetermined time has elapsed since the first temperature detector detects the surface temperature of the fixing member is greater than a predetermined threshold, the heater stops heating the metal member.

* * * * *